US006679086B1

(12) United States Patent
Hart, Jr.

(10) Patent No.: US 6,679,086 B1
(45) Date of Patent: Jan. 20, 2004

(54) PROTECTIVE SHEATH FOR PADLOCK

(76) Inventor: Charles Richard Hart, Jr., 418 Via De La Paz, Pacific Palisades, CA (US) 90272

( * ) Notice: Subject to any disclaimer, the term of this patent is extended or adjusted under 35 U.S.C. 154(b) by 0 days.

(21) Appl. No.: 10/229,517

(22) Filed: Aug. 27, 2002

(51) Int. Cl.[7] ..... E05B 67/38
(52) U.S. Cl. ..... 70/56; 70/417
(58) Field of Search ..... 70/50–56, 417, 70/DIG. 43, DIG. 56

(56) References Cited

U.S. PATENT DOCUMENTS

| | | | | | |
|---|---|---|---|---|---|
| 3,453,846 | A | * | 7/1969 | Owen et al. | |
| 3,800,570 | A | * | 4/1974 | Kaplan | 70/18 |
| 3,808,847 | A | * | 5/1974 | Vesely | 70/18 |
| 4,106,315 | A | * | 8/1978 | Dohanyos | 70/56 |
| 4,226,100 | A | * | 10/1980 | Hampton et al. | 70/51 |
| 4,297,861 | A | * | 11/1981 | Dykes | 70/55 |
| 4,300,373 | A | * | 11/1981 | Camos et al. | 70/232 |
| 4,781,043 | A | * | 11/1988 | Loeffler | 70/54 |
| 5,216,903 | A | * | 6/1993 | Chen | 70/55 |
| 5,410,893 | A | * | 5/1995 | Easterwood | 70/14 |
| 5,588,314 | A | * | 12/1996 | Knezovich | 70/56 |
| 5,765,408 | A | * | 6/1998 | Sanseverino | 70/14 |
| 5,931,030 | A | * | 8/1999 | Chen | 70/38 A |
| 6,012,309 | A | * | 1/2000 | Liu | 70/25 |
| 6,058,745 | A | * | 5/2000 | Sanchez | 70/56 |
| 6,351,975 | B1 | * | 3/2002 | Valdes | 70/56 |
| 6,393,876 | B1 | * | 5/2002 | Matyko | 70/38 A |
| 6,405,570 | B1 | * | 6/2002 | Middleton et al. | 70/174 |
| 6,439,008 | B1 | * | 8/2002 | Keil | 70/56 |
| 6,519,982 | B1 | * | 2/2003 | Brammall et al. | 70/56 |

FOREIGN PATENT DOCUMENTS

| | | | | |
|---|---|---|---|---|
| GB | 2233036 | * | 1/1991 | 70/417 |

* cited by examiner

*Primary Examiner*—Lloyd A. Gall
(74) *Attorney, Agent, or Firm*—Kelly Bauersfeld Lowry & Kelley, LLP

(57) ABSTRACT

A padlock having a lock body defining an interior cavity includes a locking mechanism operably disposed within the inner cavity. A shackle is releasably lockable to the body in the closed position for securing an object, and movable to an open position for receiving and releasing the object. A protective sheath is attached to the shackle so as to substantially encase exposed portions of the shackle in the closed position. The sheath defines a closed space between the sheath and the lock body for securing an object, and is movable with the shackle into an open position for receiving and releasing the object.

6 Claims, 3 Drawing Sheets

PROTECTIVE SHEATH FOR PADLOCK

BACKGROUND OF THE INVENTION

The present invention generally relates to padlocks. More particularly, the present invention relates to a protective sheath for a shackle of the padlock to prevent tampering and the like.

Numerous locks, such as shackle locks or padlocks have been proposed. These locks typically comprise a body of steel or reinforced material housing a locking mechanism, such as a combination-actuated mechanism or key-actuated mechanism. Typically a U-shaped shackle is permanently and rotatably attached at one end to the locking body, and upon actuating the locking mechanism a free end is insertable through an aperture or around the object to be secured. The free end of the shackle is then inserted into the locking mechanism within the body to secure the object to another object, or prevent the opening of an object, such as with a hasp or the like. Such locks are typically designed so as to be highly resistant to pounding, twisting and prying. The shackles are often "hardened"to resist cutting.

However, these locks are still susceptible to attack, especially from a prying or cutting force applied to the shackle. Attempts at providing additional protection from attack have led to the use of protective shells placed over the padlock. Typically, the padlock is inserted within a protective shell to deter forced attack. These padlocks, and shells, however, do not obscure a significant portion of the shackle, especially where it enters the padlock. Further, these shells are still susceptible to being pried away from the lock or allowing a prying member to attack the padlock directly or would necessarily have a loose fit, enabling the shell to slide off the lock.

There is known a padlock having a sheath which encases only a portion of the shackle so as to prevent bolt covers or the like to cut through the shackle. However, the shackle is not completely encased in such a protective sheath, allowing bolt cutters or the like to clamp onto at least a portion of the shackle and cut therethrough.

Accordingly, there is a continuing need for a protective shell that is form-fittingly attached to a shackle of the padlock so as to obscure a significant portion, or even completely obscure, the shackle. Preferably, such a protective shell or sheath should be designed such so that seams are not aligned with seams of the padlock, to further deter prying open of the padlock body. The present invention fulfills these needs and provides other related advantages.

SUMMARY OF THE INVENTION

The present invention resides in a padlock having a protective sheath so as to resist tampering and the like. The padlock generally comprises a lock body defining an interior cavity having a locking mechanism operably disposed therein. The locking mechanism may comprise a combination-actuated locking mechanism, but more preferably comprises a key-actuated locking mechanism. A shackle is releasably lockable to the body in the closed position for securing an object, and movable to an open position for receiving and releasing the object.

A sheath is attached to the shackle so as to substantially encase portions of the shackle that are exposed when the shackle is in the closed position. Preferably, the sheath completely encases the exposed portion of the shackle. The sheath defines a closed space between the sheath and the locked body for securing an object, and is movable with the shackle into an open position for receiving and releasing the object. The sheath is comprised of a material of sufficient strength for protecting the shackle, such as from cutting or prying and the like.

Typically, padlocks include a generally U-shaped shackle including parallel shafts interconnected by an arch. In such case, the sheath comprises a top sheath encasing the arch, and side sheaths encasing the shafts. In a particularly preferred embodiment, the side sheaths each include top flanges that are in overlapping relationship with the top sheath, and bottom flanges that overlap an upper edge of the body when the shackle is in the closed position.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
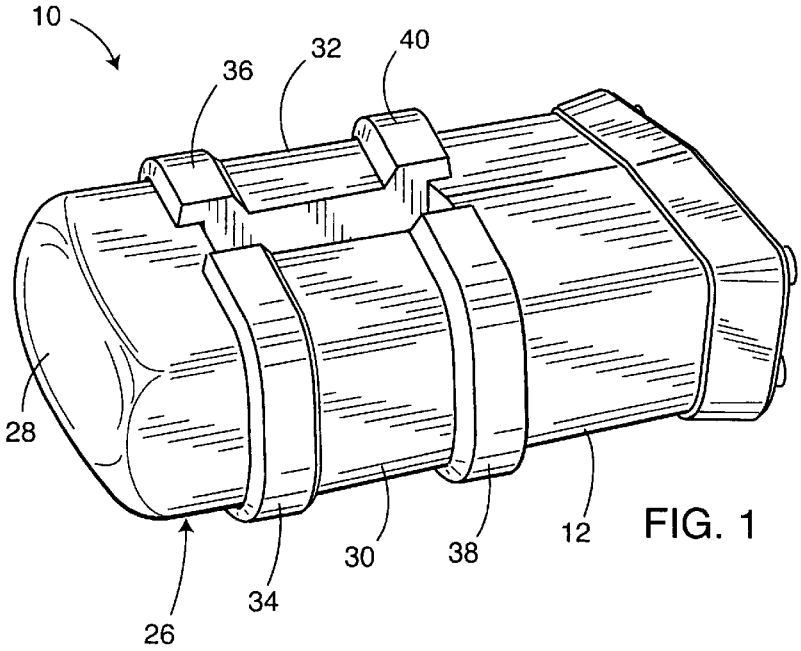
FIG. 1 is a perspective view of a padlock embodying the present invention in a closed state.

As shown in the accompanying drawings for purposes of illustration, the present invention resides in a padlock, generally referred to by the reference number 10. Similar to pre-existing padlocks and the like, the padlock 10 of the present invention includes a lock body 12 comprised of metal or other material which resist forced entry. In a particularly preferred embodiment, the lock body 12 is comprised of a plurality of metal laminated plates secured together by rivets 14. The lock body 12 has an inner cavity housing a locking mechanism 16. Such locking mechanism can be of any type which are well known in the prior art, including the combination-type locking mechanisms wherein a dial is used to unlock the padlock 10, or more preferably, as illustrated, a key-actuated locking mechanism, as shown in FIG. 7 wherein a key 18 is used to open the padlock 10.

Figure 2:
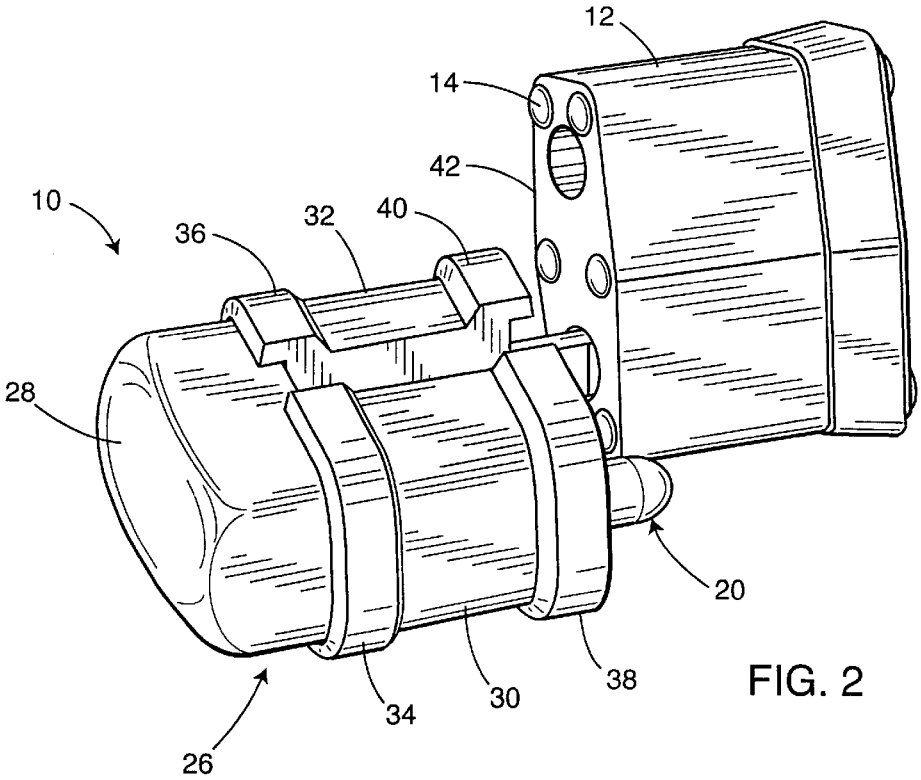
FIG. 2 is a perspective view of the padlock in an open state.
Figure 7:
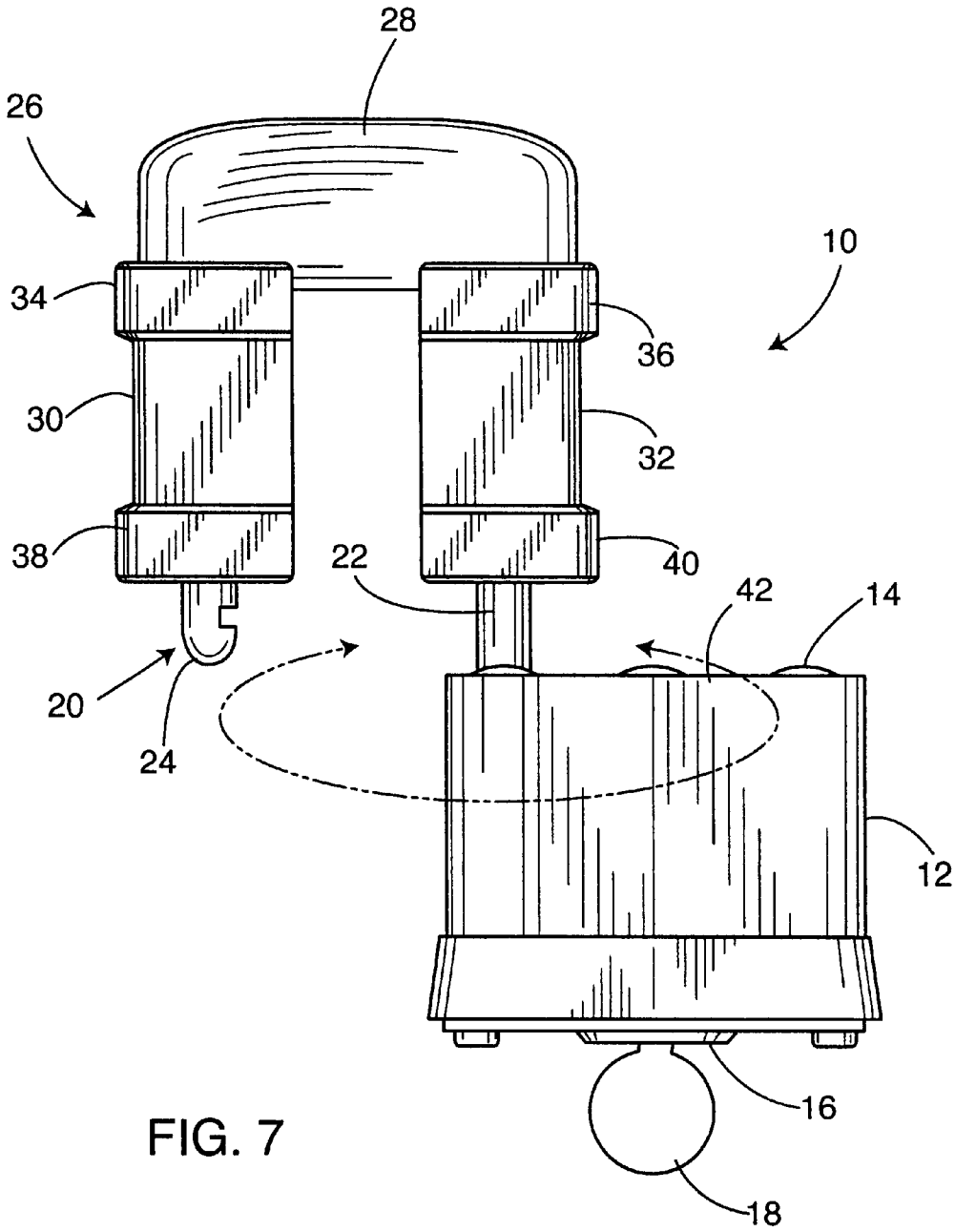
FIG. 7 is a front elevational view of the padlock of the present invention in an unlocked and opened position.

As is typically the case of padlocks, the padlock 10 of the present invention includes a shackle 20 having one end 22 permanently attached to the lock body 12, and an opposite free end 24 which is releasably lockable to the body 12 in the closed position for securing an object, and movable to an open position for receiving and releasing the object, as shown in FIGS. 2 and 7. Typically such shackles 20 are generally U-shaped and include parallel shafts interconnected by an arch to form a unitary member. In the past, a common manner of destroying a padlock in order to open a door or release an object was to use bolt cutters or the like to cut through the shackle 20. The present invention is particularly concerned with the protection of the shackle 20 to prevent such unlocking and destruction to the padlock 10.

As shown in the various figures, the present invention includes a sheath, generally referred to by the reference number 26. The sheath is of substantial thickness and comprised of a material selected to have sufficient strength for protecting the shackle 20 from such cutting and tampering. Typically, the sheath 26 is comprised of a metal, such as steel, lead, etc. However, other sufficiently strong and durable materials, such as carbon fiber-based materials, can also be utilized in order to achieve the same objectives.

A particularly preferred embodiment of the sheath 26 is illustrated in the accompanying drawings. It will be noted that the shackle 20 is substantially encased within the protective sheath 26, and that all exposed portions of the shackle 20 when in the closed and locked position are encased by the protective sheath 26. This prevents a would be thief or the like from cutting the shackle 20 at an exposed portion thereof. The sheath 26 preferably comprises a top sheath 28 encasing the top arch portion of the shackle 20. The parallel shafts of the shackle are encased with side sheaths 30 and 32.

In the particularly preferred embodiment illustrated, the side sheaths 30 and 32 each include an upper flange 34 and 36 that overlaps a bottom edge of the top sheath 28. This prevents a would be tamperer from applying a prying force at a seam between the sheath members 28–32. The sheath 26 may be formed as a single unitary member, or in three individual pieces interconnected as shown. The top flanges 34 and 36 allow the sheath 26 to be comprised of three distinct members while providing the benefits of a single unitary member. Use of three members is anticipated to facilitate construction and assembly of the padlock 10.

Figure 3:
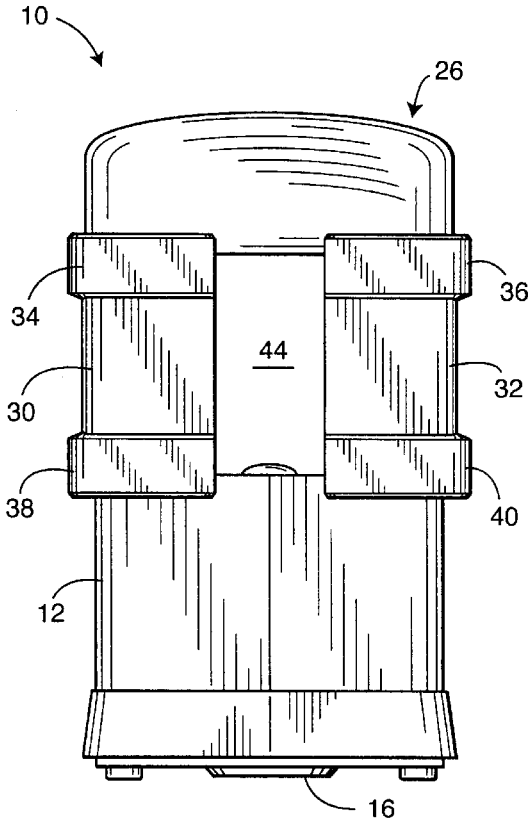
FIG. 3 is a front elevational view of the padlock of the present invention in a closed state.
Figure 4:
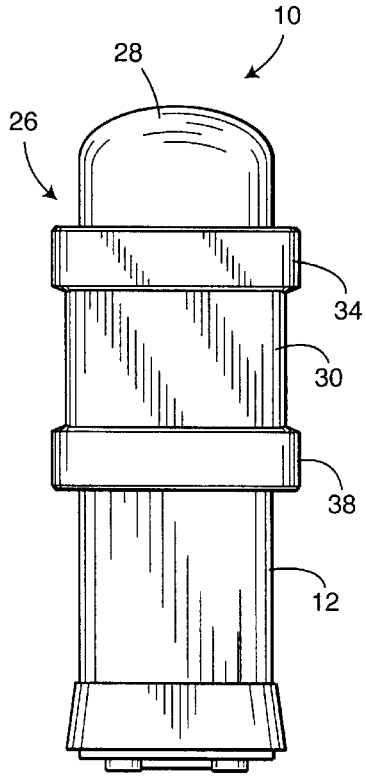
FIG. 4 is a side elevational view of the padlock of the present invention.
Figure 5:
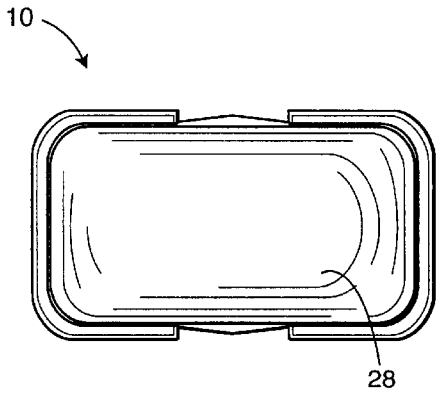
FIG. 5 is a top view of the padlock.
Figure 6:
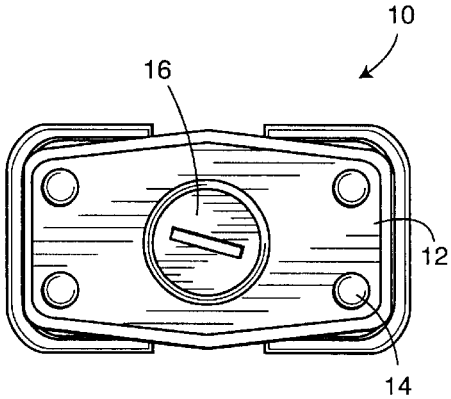
FIG. 6 is a bottom view of the padlock.

The side sheaths 30 and 32 also include bottom flanges 38 and 40 which are dimensioned such so as to overlap a top edge 42 of the lock body 12 when the shackle 20 is in the closed and locked position, as shown in FIGS. 1, 3 and 4. Once again, the overlapping nature of the flanges 38 and 40 to the lock body 12 prevents attack from prying force applied between the sheath 26 and the lock body 12. Such overlapping relationship also prevents the insertion of thin cutting members, such as blades or wires between the lock body 12 and the sheath 26 so as to gain access to a portion of the shackle 20.

Referring now to FIG. 3, when the padlock 10 is in the closed and locked position, the sheath 26 defines an enclosed space 44 between it and the lock body 12 for securing an object. As shown in FIG. 7 when the padlock 10 is unlocked and opened, the sheath 26 which is attached to the shackle 20 moves with the shackle 20 into an open position for receiving and releasing the object. As such, the sheath 26 is not susceptible to being pried away from the lock 10, nor is the sheath 26 enabled to slide off of the lock 10 as it is permanently attached to the shackle 20 thereof.

It will be appreciated by the reader that the protective sheath 26 as described herein will significantly improve the protection from attack on the padlock 10 while enabling the padlock 10 to perform its functions in traditional fashion.

Although several embodiments have been described in detail for purposes of illustration, various modifications may be made without departing from the scope and spirit of the invention. Accordingly, the invention is not to be limited, except as by the appended claims.

What is claimed is:

1. A padlock, comprising:

a lock body defining an interior cavity;

a locking mechanism operably disposed within the inner cavity;

a shackle releasably lockable to the body in the closed position for securing an object, and movable to an open position for receiving and releasing the object; and a sheath attached to the shackle and substantially encasing portions of the shackle that are exposed when in the closed position, the sheath defining an enclosed space between the sheath and the body for securing an object, and movable with the shackle into an open position for receiving and releasing the object, wherein the sheath is comprised of a material of sufficient strength for protecting the shackle;

wherein the shackle is generally U-shaped and includes parallel shafts interconnected by an arch, and wherein the sheath comprises a top sheath encasing the arch, and side sheaths encasing the shafts; and wherein each side sheath includes a top flange in overlapping relationship with the top sheath, and a bottom flange that overlaps an upper edge of the body when the shackle is in the closed position.

2. The padlock of claim 1, wherein the sheath completely encases the exposed portion of the shackle.

3. The padlock of claim 1, wherein the locking mechanism comprises a key-actuated locking mechanism.

4. A padlock, comprising:

a lock body defining an interior cavity;

a locking mechanism operably disposed within the inner cavity;

a generally U-shaped shackle releasably lockable to the body in the closed position for securing an object, and movable to an open position for receiving and releasing the object, the shackle having parallel shafts interconnected by an arch; and a sheath attached to the shackle and completely encasing portions of the shackle that are exposed when in the closed position, the sheath comprising a top sheath encasing the arch, and side sheaths encasing the exposed portions of the shafts, the sheath defining an enclosed space between the sheath and the body for securing an object, and movable with the shackle into an open position for receiving and releasing the object, wherein the sheath is comprised of a material of sufficient strength for protecting the shackle;

wherein each side sheath includes a top flange in overlapping relationship with the top sheath, and a bottom flange that overlaps an upper edge of the body when the shackle is in the closed position.

5. The padlock of claim 4, wherein the locking mechanism comprises a key-actuated locking mechanism.

6. A padlock, comprising:

a lock body defining an interior cavity;

a key-actuated locking mechanism operably disposed within the inner cavity;

a generally U-shaped shackle releasably lockable to the body in the closed position for securing an object, and movable to an open position for receiving and releasing the object, the shackle having parallel shafts interconnected by an arch; and a sheath attached to the shackle and completely encasing portions of the shackle that are exposed when in the closed position, the sheath comprising a top sheath encasing the arch, and side sheaths encasing the exposed portions of the shafts, the sheath defining an enclosed space between the sheath and the body for securing an object, and movable with the shackle into an open position for receiving and releasing the object;

wherein the sheath is comprised of a material of sufficient strength for protecting the shackle; and wherein the side sheaths each include a top flange in overlapping relationship with the top sheath, and a bottom flange that overlaps an upper edge of the body when the shackle is in the closed position.

* * * * *